US007473024B2

(12) United States Patent
Gibboney

(10) Patent No.: US 7,473,024 B2
(45) Date of Patent: Jan. 6, 2009

(54) LIGHT STRINGS INCLUDING STANDARD SOCKET AND LONGER-LENGTH NON-STANDARD KEYED SOCKET

(75) Inventor: James W. Gibboney, Conyers, GA (US)

(73) Assignee: Ventur Research & Development Corp., St. Augustine, FL (US)

( * ) Notice: Subject to any disclaimer, the term of this patent is extended or adjusted under 35 U.S.C. 154(b) by 149 days.

(21) Appl. No.: 11/215,461

(22) Filed: Aug. 30, 2005

(65) Prior Publication Data

US 2007/0081333 A1 Apr. 12, 2007

(51) Int. Cl.
*H01R 33/09* (2006.01)

(52) U.S. Cl. ..... 362/654; 362/644; 362/655; 439/699.2

(58) Field of Classification Search ..... 362/644, 362/652, 654, 655, 806; 313/318.09, 318.1, 313/318.01; 439/611, 612, 619, 699.2, 375
See application file for complete search history.

(56) References Cited

U.S. PATENT DOCUMENTS 3,233,207 A * 2/1966 Ahroni et al. ..... 439/611
3,968,398 A * 7/1976 Lehmann et al. ..... 315/185 S
4,943,899 A * 7/1990 Tseng ..... 362/654
5,137,465 A * 8/1992 Chwang ..... 439/356
5,647,771 A * 7/1997 Shu ..... 439/699.2
5,697,698 A * 12/1997 Huang ..... 362/657
5,700,082 A * 12/1997 Peng ..... 362/654
5,707,138 A * 1/1998 Pan ..... 362/657
5,816,862 A * 10/1998 Tseng ..... 439/699.2
5,993,024 A * 11/1999 Tseng ..... 362/657
6,019,483 A * 2/2000 Lin ..... 362/653
6,023,127 A * 2/2000 Huang ..... 313/318.01
6,043,593 A * 3/2000 Pan ..... 313/318.01
6,083,055 A * 7/2000 Chuang ..... 439/699.2
6,376,974 B1 * 4/2002 Tsai ..... 313/318.01
6,382,810 B1 * 5/2002 Tseng ..... 362/653
6,382,813 B1 * 5/2002 Huang ..... 362/249
6,474,841 B1 * 11/2002 Rahman ..... 362/252
6,774,549 B2 * 8/2004 Tsai et al. ..... 313/318.01
6,799,867 B1 * 10/2004 Cheng ..... 362/249
6,806,656 B2 * 10/2004 Rahman ..... 315/185 R
7,063,442 B2 * 6/2006 Sugar ..... 362/252
2004/0080936 A1 * 4/2004 Chang ..... 362/226
2004/0080937 A1 * 4/2004 Chang ..... 362/226

* cited by examiner

*Primary Examiner*—Ismael Negron
(74) *Attorney, Agent, or Firm*—Michael A. Mann; Nexsen Pruet, LLC

(57) ABSTRACT

A light for use in light strings has a deeper socket, a longer base and longer Dumet wires than a standard socket, base, and Dumet wires so that the standard bases and bulbs will not operate in the non-standard socket. Furthermore, the base and sockets are keyed so that they are restricted to at most two orientations with respect to each other and cannot be twisted with respect to each other.

7 Claims, 4 Drawing Sheets

AMENDED

LIGHT STRINGS INCLUDING STANDARD SOCKET AND LONGER-LENGTH NON-STANDARD KEYED SOCKET

CROSS REFERENCE TO RELATED PATENTS

Not applicable

BACKGROUND OF THE INVENTION

The present invention relates to strings of lights and, in particular, to special application lights used in strings of lights, such as fuse lights and flicker lights. In the present specification, the word light will be used to denote the combination of a bulb, bulb base (or simply "base"), and socket.

Light strings such as the type used to decorate Christmas trees may include sets of 50 or 100 miniature lights arranged electrically in series. In addition to standard lights used in these sets, which meet industry standards set by Underwriters Laboratories (UL Standard 588, in particular), manufacturers have created lights that serve special functions, such as flicker or twinkle lights and fuse lights. While in some cases these special application bulbs may be used in any socket in the light string and in any number, in other cases, the manufacturer may want to limit the number of these special application lights in the string, use them only in special sockets, and even to confine them to specific locations. Under these types of circumstances, the manufacturer may have to anticipate that consumers might inadvertently or through ignorance attempt to place bulbs in the wrong sockets of the light string, and, accordingly, incorporate features into their light string designs to prevent these actions.

One way for manufacturers to achieve this goal of limiting the number and the location of these special application lights in a light string is to make them non-removable from their sockets. However, a determined user, with sufficient effort, can sometimes remove so-called non-removable bulbs. However, this determined consumer may then be confronted by a pair of bare, live wires.

Another way to limit the location and type of special application lights in a light string is to make special application sockets only receive the special application bulb or make special application sockets so that, although they will receive standard bulbs, only special application bulbs will be operable. In addition, manufacturers in some cases will also design special application bulbs so that they will not work in standard sockets.

Another, different, problem facing manufacturers and users of conventional light strings, is that the bulbs can be twisted within their sockets, that is, rotated about their long axis with respect to the sockets. In a conventional set, when a conventional bulb is twisted enough, it will fail. When one light in a conventional series circuit fails, a shunt in the light will enable the socket to pass the electrical current through to the next light so the balance of the light string continues to function. However, the current being carried by remaining lights in the string will be incrementally higher, and the light incrementally brighter, than before. Pranksters have been known to twist one bulb after another in a light string, with the remaining lights getting progressively brighter, until the whole light string fails. This form of amusement creates a dangerous fire hazard.

There remains a need for better lights and better special application lights in particular.

SUMMARY OF THE INVENTION

According to its major aspects and briefly recited, the present invention is a light for special applications. The special application light has a bulb, a base and a socket that are not interchangeable with a standard bulb, base and socket. The present bulb and base will not fit into a standard socket and the present socket will not receive a standard bulb and base. If a standard bulb and base are somehow forced into the present socket, the standard bulb will not operate. If the present bulb and base are somehow forced into a standard socket, it will be clear that they are not intended to be used together because the base will not fit and will be too long for the socket. Furthermore, the present base and socket are designed so that the base cannot be twisted with respect to the socket when the base is seated in the socket.

The present special application socket is longer than a standard socket and keyed to fit a longer light base. The Dumet wires of the present light are longer in order to be able to make electrical contact with the electrical wire contacts in the deeper special application base and socket of the present design. Standard length Dumet wires are too short to make contact with the electrical wire contacts in the present special application socket.

An important advantage of the present invention is that the bulb base is easily removable from the socket. Prior art bulb bases that are made to be not removable, and can invite the use of excessive force by users who try to remove them, which may result in a possible safety hazard. In the case of the present special application sockets, the lamp socket and base are not tapered but are straight, so that the base can be removed from the socket.

An important feature of the present invention is the use of a longer socket. In addition to being important to preventing a standard bulb from being operable in the present special application socket, a longer socket looks different than a standard socket and can thus be visually identified quickly.

Still another important feature of the present invention is the keying of the light base and socket to prevent twisting of one with respect to the other. Keying means that complementary patterns of slots and grooves are formed on the socket and base to make it impossible for one to be rotated with respect to the other when the base is fully seated in the socket. Second, the keying prevents the interchanging of standard bulbs and sockets with the present special application bulbs and sockets. Third, the keying helps maintain the alignment of Dumet wires with electrical contacts within the socket and prevents their misalignment when bases are inserted into sockets.

These and other features and their advantages will be apparent to those skilled in the art of light string design from a careful reading of the Detailed Description of Preferred Embodiments accompanied by the following drawings.

DETAILED DESCRIPTION OF THE INVENTION

The present invention is a special application light. The present light has a bulb, a base and a socket. The base and bulb will only be operable in the present socket. Although the bulb and base are easily removable from the socket without undue effort, the present bulb and base cannot be twisted with respect to the present socket once seated. Furthermore, if a standard bulb and base were somehow forced into the present socket, a feat that requires considerable effort, the standard bulb and base would not function. Finally, the present socket, being longer than a standard socket, is easily visually distinguished from the standard socket.

Figure 1:
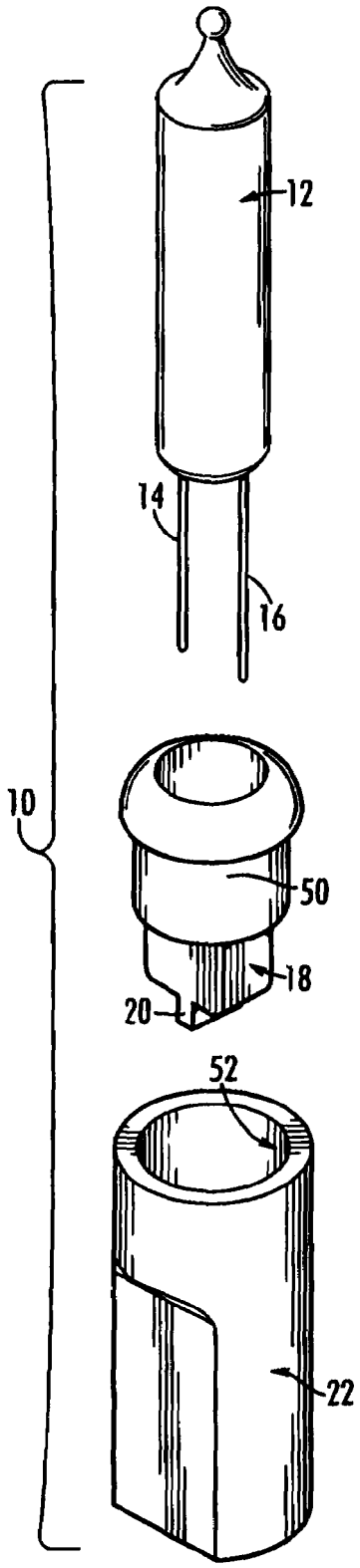
FIG. 1 PRIOR ART
FIG. 1 is a perspective, exploded view of a prior art, standard miniature light for use in a light string.
Figure 2:
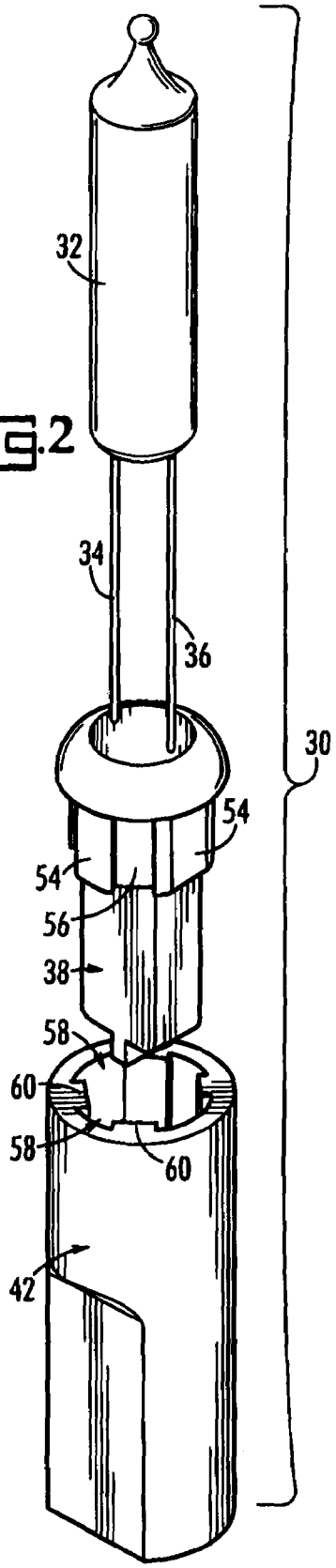
FIG. 2 is a perspective, exploded view of the present special application light for use in a light string, according to a preferred embodiment of the present invention.

Referring now to FIGS. 1 and 2, there is shown an exploded perspective view of a prior art light 10 in FIG. 1 and of the present light 30 in FIG. 2, according to a preferred embodiment of the present invention. These exploded perspective views highlight the differences between the prior art light and the present light.

In FIG. 1, light 10 has a bulb 12, typically made of glass or plastic, with a first Dumet wire 14 and a spaced-apart second Dumet wire 16 extending out of bulb 12. Inside bulb 12, Dumet wires 14, 16, are connected in series across a filament, in accordance with prior art bulb design. The portions of first and second Dumet wires 14, 16, extending outside of bulb 12 are inserted through a base 18 and, once in place, are bent back toward the outside of base 18 on opposing sides of a divider 20. When bulb 12 and base 18 are inserted into a socket 22, first and second Dumet wires 14, 16, come into electrical contact with electrical terminals located on the walls inside socket 22.

Significantly, the outside of base 18 and the inside of socket 22 in prior art light 10 are tapered by a few degrees so that they can be forced together tightly enough to keep out rainwater. In addition, this prior art design has two consequences. First, it allows use of old, worn, out of tolerance molds, and, second, it sometimes results in base 18 that is so tightly stuck into socket 22 that they require more pull force than it takes to separate socket 22 from the live electrical wires leading into it. As a consequence, the user, in attempting to separate base 18 from socket 22, may be exposed to an electrical hazard of the wires instead.

In FIG. 2, a bulb 32 with longer first and spaced-apart second Dumet wires 34, 36, extending therefrom are inserted through base 38, and, once fully inserted, are bent toward the outside of base 28 on opposing sides of a divider 40, as in the prior art light 10. However, first and second Dumet wires 34, 36, are longer, preferably 5 mm longer, and base 38 is also longer, again by preferably 5 mm. Socket 42 is also longer to receive the longer base 38 and the inside of socket 42 and outside of base 38 are straight and untapered so that they separate with less force than socket 42 separates from the wires leading into socket 42.

Figure 3A:
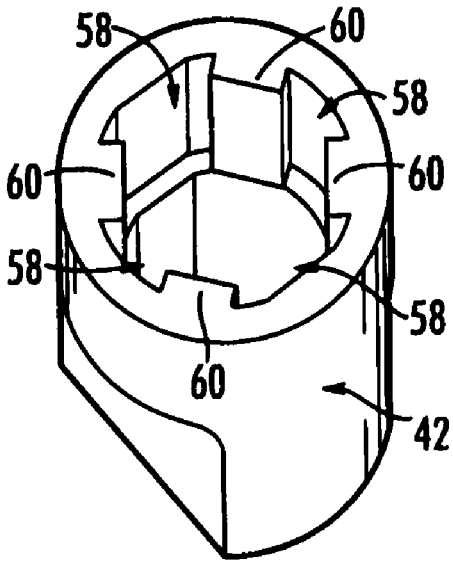
FIG. 3A is a perspective view of the light socket showing the keying, according to a preferred embodiment of the present invention.
Figure 3B:
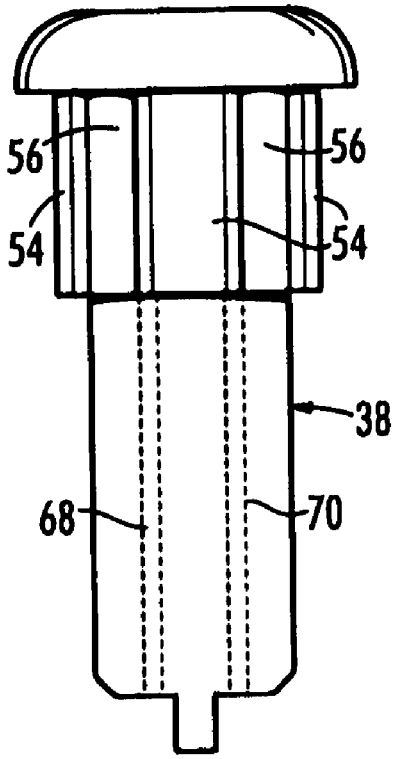
FIG. 3B is a side view of the light base according to a preferred embodiment of the present invention.

Additionally, while both base 18 and base 38 are friction fitted to their respective sockets 22, 42, base 18 has a smooth collar 50 and socket 22 has a smooth bore 52. In contrast, base 38 is keyed to allow socket 42 to be inserted easily only in fixed orientations so that it cannot be twisted. In particular, base 38 and socket 42 are keyed so that the possible orientations of one with respect to the other are not infinite, as in the prior art light of FIG. 1, but finite, preferably limited to two orientations 180° apart. This limitation of orientations is achieved by using a combination of ribs 54 and grooves 56 on base 38 and grooves 58 and ribs 60 on socket 42. See also FIGS. 3A and 3B.

Figure 4A:
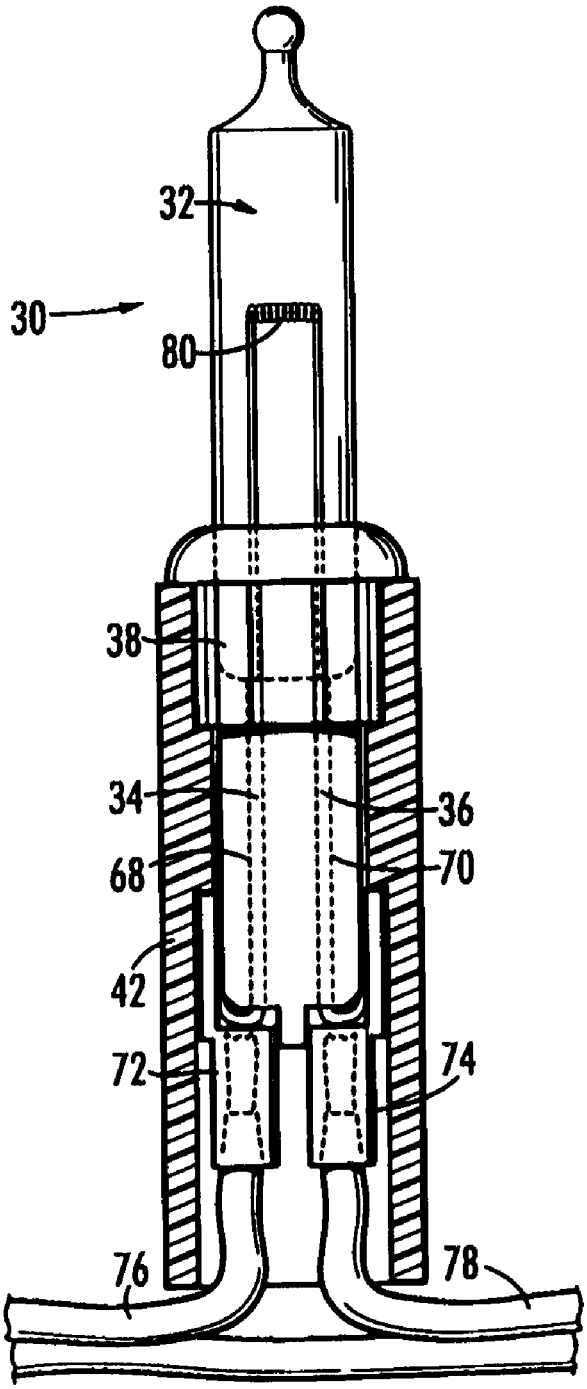
FIGS. 4A and 4B are side, partially cutaway views of the present bulb, base and socket (FIG. 4A), according to a preferred embodiment of the present invention, and a standard bulb and base forced into the present socket.

FIG. 4A illustrates, in a partially cut away side view of the present special application light 30 ,the fit of bulb 32 and base 38 into socket 42. First and second Dumet wires 34, 36 extend downward through holes 68, 70, respectively, in base 38 and emerge from the bottom of base 38 where they are folded outwardly against the outsides of base 38. Inside socket 42 are two terminals 72, 74 that are connected to wires 76, 78, of the light string. When base 38 is inserted into socket 42, first and second Dumet wires 34, 36 come into electrical contact with terminals 72, 74, respectively, and electrical current can flow from wire 76 to terminal 72, to first Dumet wire 34, and across a filament 80 inside bulb 32 to second Dumet wire 36 to second terminal 74 and on to second wire 78.

Figure 4B:
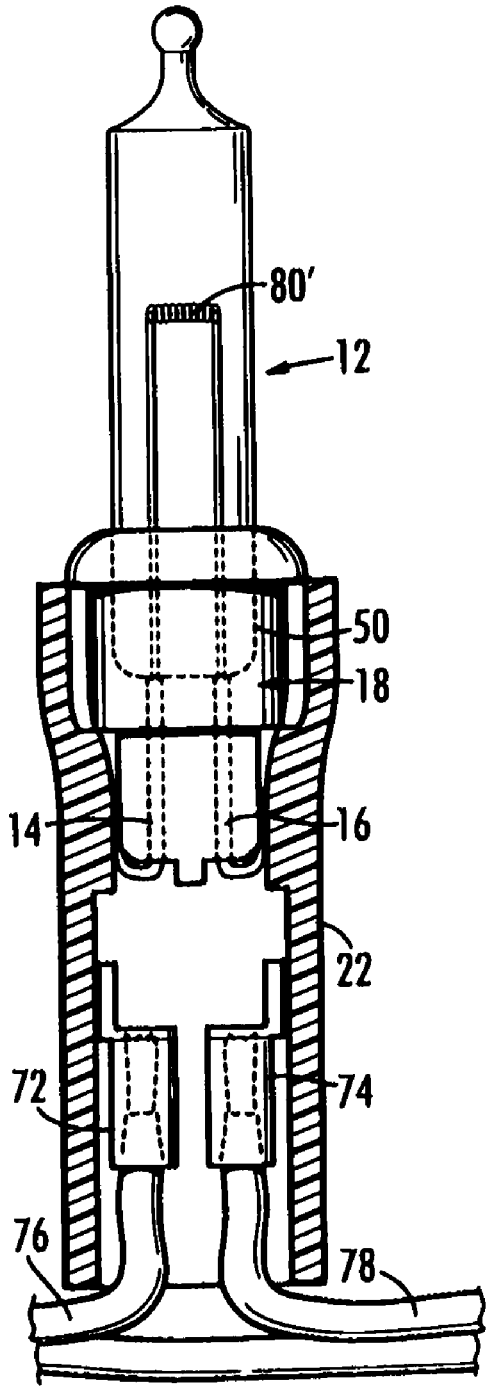

As illustrated in FIG. 4B, if somehow through the use of considerably force, a standard base 18 with a smooth collar 50 were inserted into socket 42 notwithstanding the interference of ribs 60 with base 18, base 18 would be too short and first and second Dumet wires 14, 16, would be too short, as shown, to reach terminals 72, 74 to allow electrical current to flow from wire 76 to wire 78 via first and second Dumet wires 14, 16, and a filament 80' in bulb 12.

Thus, ribs 54 and grooves 56 of base 38 and the correspondingly keyed grooves 58 and ribs 60 of socket 42 prevent base 38 from being twisted with respect to socket 42. Moreover, they assist in making sure that first and second Dumet wires 34, 36, are in physical and, hence, electrical contact with first and second terminals 72, 74. Also, by making first and second Dumet wires slightly longer, making base 38 also slightly longer, and making socket 42 slightly deeper, all about 5 mm longer, only the combination of the present bulb, base and socket is a working combination. Standard light bulb 12 and base 18 will not operate even if forced into socket 42 as shown because first and second Dumet wires 14, 16, will not reach first and second terminals 72, 74.

Figure 5:
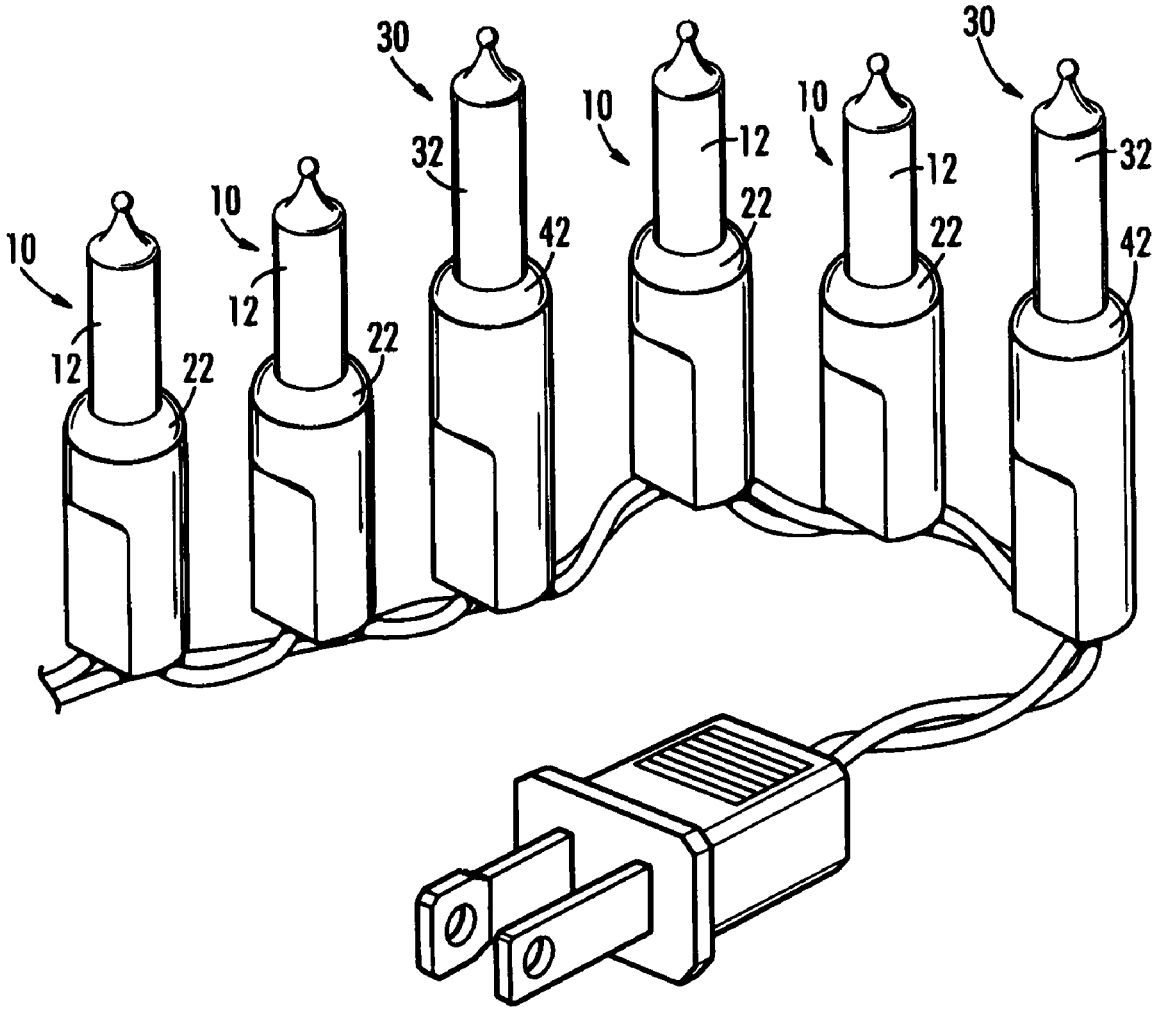
FIG. 5 is a partial view of a string of lights having plural standard lights and at least one special application light, according to a preferred embodiment of the present invention.

FIG. 5 illustrates a portion of a string of lights 30 with the present special application light 32 plural standard lights 12. It will be clear that the special application lights 32 are slightly larger, and longer in particular by preferably about 5 mm.

It is intended that the scope of the present invention include all modifications that incorporate its principal design features, and that the scope and limitations of the present invention are to be determined by the scope of the appended claims and their equivalents. It also should be understood, therefore, that the inventive concepts herein described are interchangeable and/or they can be used together in still other permutations of the present invention, and that other modifications and substitutions will be apparent to those skilled in the art from the foregoing description of the preferred embodiments without departing from the spirit or scope of the present invention.

What is claimed is:

1. A light string, comprising:

(a) plural standard lights, each standard light being in electrical series with each other standard light of said plural standard lights, said each standard light including a standard bulb having a pair of Dumet wires, a standard base receiving said standard bulb, said standard base having an exterior and said exterior having a length, and a standard socket receiving said standard base, said standard socket having an interior and said interior having a length, said standard light being operative when said standard bulb is received by said standard base and said standard base is received by said standard socket; and (b) a non-standard light in series with said plural standard lights, said non-standard light including a non-standard bulb having a pair of Dumet wires, a non-standard base receiving said non-standard bulb, said non-standard base having an exterior and said exterior having a length, and a non-standard socket receiving said non-standard base, said non-standard socket having an interior and carrying two electrical terminals, and said interior having a length, said non-standard light being operative when said non-standard bulb is received in said non-standard base and said non-standard base is received in said non-standard socket, wherein said length of said exterior of said standard base is shorter than said length of said interior of said non-standard socket so that, when said standard base is inserted into said non-standard socket, said Dumet wires of said standard bulb do not come into contact with said two electrical terminals of said non-standard socket and said standard bulb is not operative, and wherein said exterior of said non-standard base and said interior of said non-standard socket are keyed so that said non-standard socket is adapted to receive and orient said non-standard base.

2. The light string as recited in claim 1, wherein said non-standard bulb is a fuse bulb.

3. The light string as recited in claim 1, wherein said interior of said non-standard socket and said exterior of said non-standard base are keyed to prevent twisting of said non-standard base with respect to said non-standard socket.

4. The light string as recited in claim 1, said Dumet wires of said non-standard bulb being sufficiently long to make contact with said electrical terminals when said non-standard base with said non-standard bulb is received in said non-standard socket.

5. The light string as recited in claim 1, wherein said Dumet wires of said non-standard bulb are 5 mm longer than said Dumet Wires of said standard bulb.

6. The light string as recited in claim 1, wherein said non-standard base is 5 mm longer than said standard base.

7. The light string as recited in claim 1, wherein said non-standard base and said non-standard socket are keyed so that said non-standard base fits into said non-standard socket in only two orientations 180° apart.

* * * * *